United States Patent [19]

Harrison

[11] 3,976,900

[45] Aug. 24, 1976

[54] GAS IGNITION DEVICES

[75] Inventor: Ronald Arthur Harrison, Fareham, England

[73] Assignee: Plessey Handel und Investments A.G., Zug, Switzerland

[22] Filed: Jan. 23, 1975

[21] Appl. No.: 543,313

[30] Foreign Application Priority Data

Jan. 30, 1974 United Kingdom ..... 4262/74

[52] U.S. Cl. ..... 310/8.7; 310/9.1; 317/DIG. 11

[51] Int. Cl.[2] ..... H01V 7/00

[58] Field of Search ..... 431/255; 310/8.7, 9.1; 317/81, 79, 95, DIG. 11

[56] References Cited

UNITED STATES PATENTS

| | | | |
|---|---|---|---|
| 3,262,019 | 7/1966 | Maltner et al. | 317/81 X |
| 3,463,943 | 8/1969 | Parkinson | 431/255 X |
| 3,558,903 | 1/1971 | Kiasha | 310/8.7 |

*Primary Examiner*—Edward G. Favors
*Attorney, Agent, or Firm*—Fleit & Jacobson

[57] ABSTRACT

In a piezo-electric manually-operated spark generating device the actuating mechanism comprises an actuating lever pivoted on the body of the device which accommodates the piezo-electric crystal assembly. It is arranged that in response to pivotal movement of the lever a cam rotates through a small angle between a fixed abutment and a relatively fixed head or pressure pad of the crystal assembly to exert high pressure on the crystal assembly for the generation of sparks. The cam is formed with precision by blanking or stamping from sheet metal so that it does not need to be subsequently machined as in the case of prior cam construction which would increase the cost of the cam. The stamping out or blanking of the cam from sheet metal also enables a roll pin to be formed integrally with the cam instead of being a separate member which is received by a hole in the cam.

1 Claim, 4 Drawing Figures

GAS IGNITION DEVICES

This invention relates to gas ignition devices and relates more specifically to such devices of the kind in which pressure is exerted on a piezo-electric crystal assembly for the generation of high voltage sparks between spark electrodes of the device in response to the manual operation of an actuating mechanism. Such devices are especially, but not exclusively, applicable to the ignition of gas burners in domestic gas cookers.

In one form of piezo-electric manually-operated spark generating device the actuating mechanism comprises an actuating lever pivoted on the body of the device which accommodates the piezo-electric crystal assembly, it being arranged that in response to pivotal movement of the lever a pressure member in the form of a cam which is manufactured by performing a turning operation on a steel bar to provide precisely dimensioned flats rotates through a small angle between a fixed abutment and a relatively fixed head or pressure pad of the crystal assembly to exert high pressure on the crystal assembly for the generation of sparks. For the purpose of positioning the cam correctly with respect to the piezo-crystal pressure pad a roll pin is fitted into a hole extending transversely through the cam so that the respective ends of the roll pin locate in recesses in the aforesaid fixed abutment and pressure pad of the piezo-crystal assembly.

According to the present invention there is provided a piezo-electic spark generating device comprising a piezo-electric crystal assembly having associated with it a mechanism operable for exerting pressure on the crystal assembly for the generation of sparks said mechanism including a rocking pressure member formed by stamping or blanking from sheet metal.

The pressure member of the device according to this invention does not need to be subsequently machined which would significantly increase the cost of the pressure member. Moreover, sheet metal is more readily available and cheaper material can be used (e.g. spring steel instead of silver steel).

The stamping out or blanking of the pressure member from sheet metal also enables the roll pin of the known arrangement to be formed integrally with the pressure member thereby further reducing the cost of the pressure member assembly.

It will be appreciated that according to the present invention a pressure member can be produced much more quickly and easily and to closer tolerances than the cam pressure member produced by machining bar material and, moreover, a significant saving in material can be achieved (e.g. 60%).

By way of example the present invention will now be described with reference to the accompanying drawings, in which.

Figure 2:
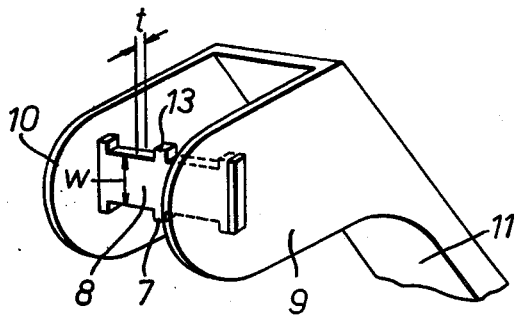
FIG. 2 shows a fragmentary perspective view of the pressure member and actuating lever of the actuating mechanism shown in FIG. 1.
Figure 4:
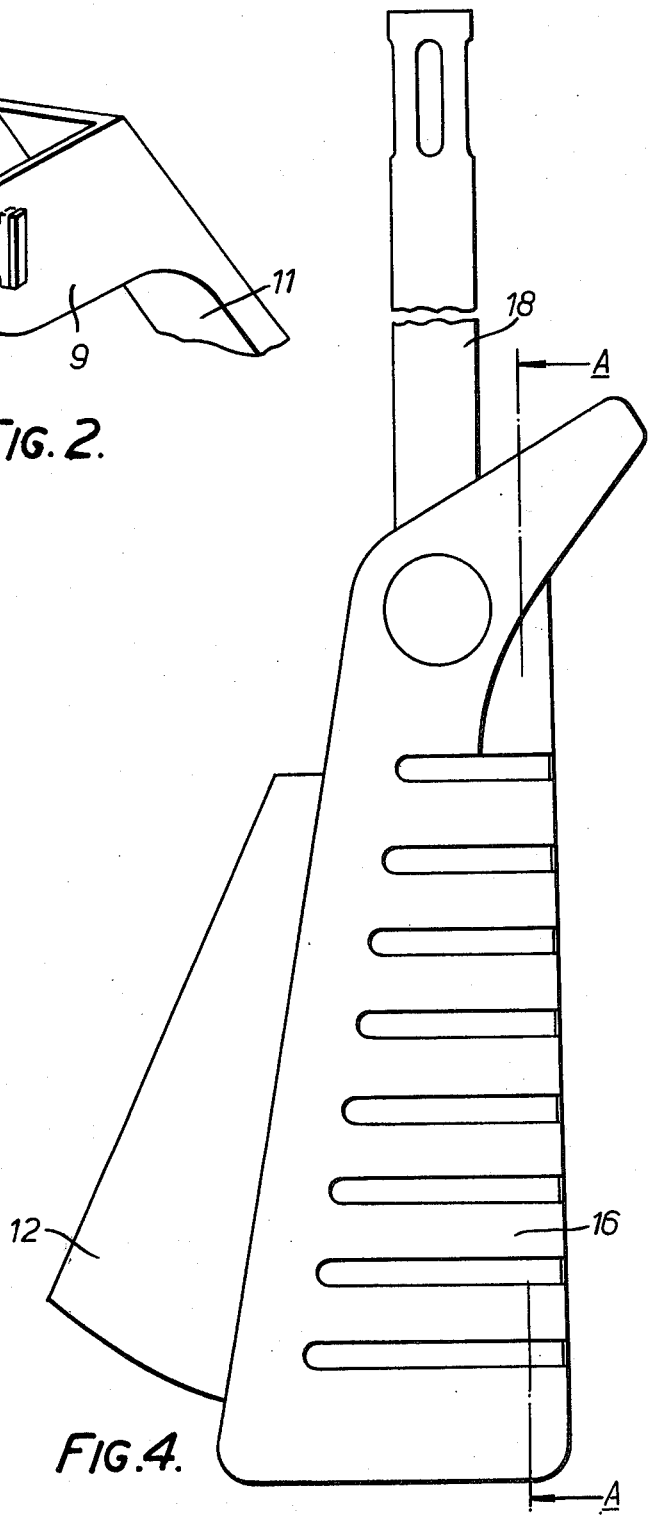
FIG. 4 is a side view of the lighter.

Referring to the drawings, the gas lighter comprises a piezo-crystal assembly 1 of generally cylindrical form having metal end caps or pads 2 and 3. The bottom pad 2 is provided with a recess which receives a tongue 4 at the end of a setting screw 5 and associated nut 6. The crystal assembly is thus pivotally supported at its bottom end. The other pad 3 at the top end of the crystal assembly 1 also has a recess therein for receiving a projection 7 on pressure member 8. The form of this pressure member 8 can best be seen in FIG. 2. The pressure member 8 is produced from hard sheet metal (e.g. spring steel) by a fine blanking operation by which the pressure member can be formed to very close tolerances (e.g. 0.2 thou. of an inch), the thickness (gauge of material $t$) to width (W) ratio of the pressure member being selected to provide the requisite "lift." The ends of the pressure member are held in slots provided in parallel lugs or ears 9 and 10 of a metal plate secured to an insulated actuating lever 12.

Figure 3:
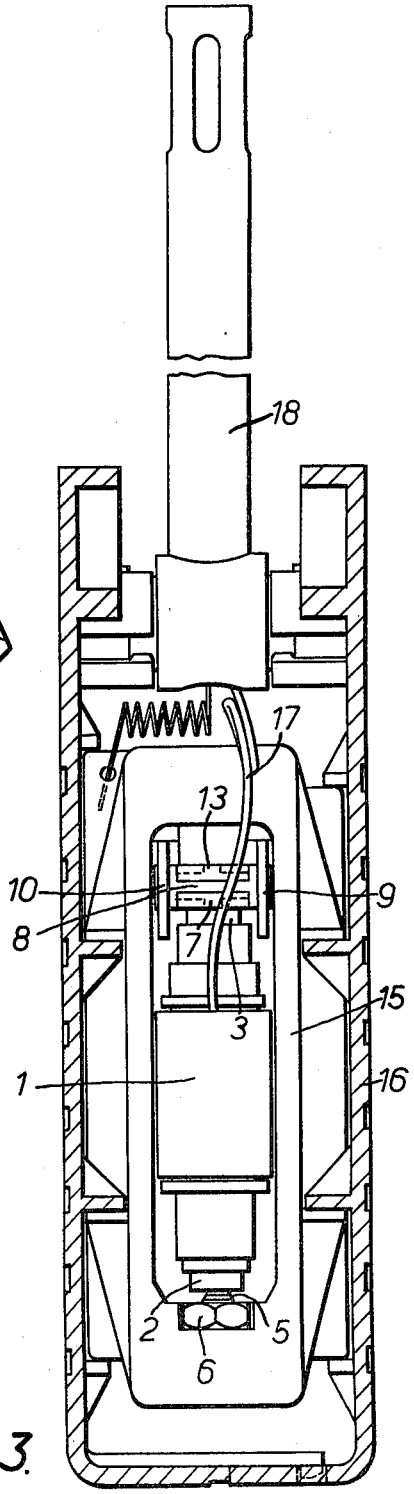
FIG. 3 is a view of the complete gas lighter with part of the body casing cut away along the line A—A in FIG. 4 to show the interior of the device.

Projection 13 formed on the upper edge of pressure member 8 locates in a recess provided in a fixed abutment or metal pad 14 which is fixed to a metal frame 15 to which the setting screw 5 is secured. Thus it will be appreciated that the projections 7 and 13 serve to locate the top end of the crystal assembly relative to the pressure member 8 and the pad 14. The frame 15 is located within a plastics-moulded body caasing 16 as can best be seen in FIG. 3.

Figure 1:
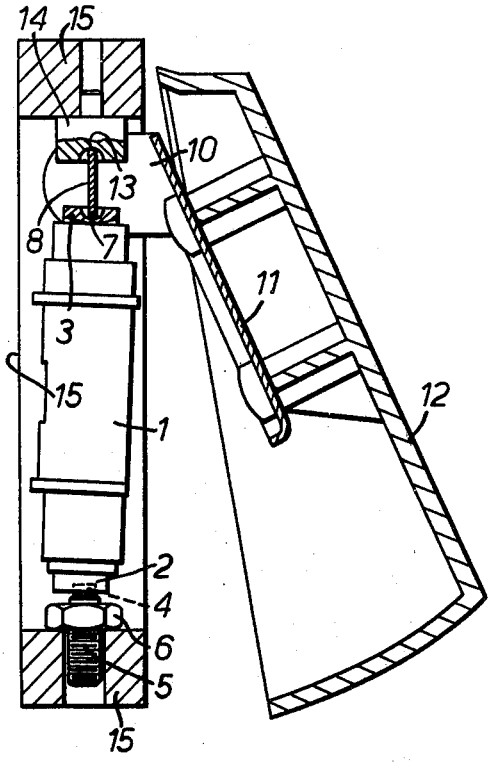
FIG. 1 is a sectional view of the piezo-crystal assembly and actuating mechanism of a hand-operated gas lighter.

In operation of the lighter, pivotal movement of the actuating arm in a direction of the arrow in FIG. 1 by squeezing the arm 12 towards the body casing 16 of the lighter causes the pressure member 8 to rotate so as to force the crystal pad 3 and the pad 14 away from one another and by so doing compress the crystal assembly 1. As a result of the crystal compression a high voltage will be generated which is conveyed by a high voltage load 17 to a centre electrode (not shown) near the top end of tubular probe 18 and causes sparking between the electrode and a spike electrode (not shown) on the inside surface of the probe. A chain of sparks (e.g. four to seven) will be produced during the squeezing operation and a similar number of sparks will be produced as the crystal restores to normal when the actuating arm is released.

The probe 18 is rotatably mounted on the body casing 16 so that the probe can be moved through a wide angle for ease or convenience of operation of the lighter.

It will be apparent from the foregoing that the cam configuration obviates the need for separate roll pin as has heretobefore been employed in such lighters and also facilitates a significant saving of material and cost by being produced with precision from sheet metal in a fine blanking process.

What we claim is:

1. A piezo-electric spark generating device comprising, in combination, a rigid frame structure having a recess, a piezo-electric crystal assembly pivotally mounted at one end on said frame structure, the other end of said crystal assembly being provided with a recess adjacent said frame structure recess, a generally rectangular, substantially flat pressure member having upper and lower edges and a projection on each of said upper and lower edges, said pressure member being disposed between said crystal assembly and said frame structure with said projections on said upper and lower edges in engagement with said frame structure recess and said crystal assembly recess respectively and lever means connected to said pressure member for rotating said pressure member to pivot said crystal assembly thereby compressing said crystal assembly between said frame structure and said pressure member.

* * * * *